US005764261A

United States Patent [19]

Koike et al.

[11] Patent Number: 5,764,261

[45] Date of Patent: Jun. 9, 1998

[54] INK FOR INK-JET PRINTING AND THE PRINTING PROCESS THEREWITH

[75] Inventors: Shoji Koike, Yokohama; Masahiro Haruta, Tokyo; Koromo Shirota, Kawasaki; Aya Yoshihira, Yokohama; Tomoya Yamamoto; Mariko Suzuki, both of Kawasaki, all of Japan

[73] Assignee: Canon Kabushiki Kaisha, Tokyo, Japan

[21] Appl. No.: 548,620

[22] Filed: Oct. 26, 1995

[30] Foreign Application Priority Data

Oct. 28, 1994 [JP] Japan ..... 6-265215
Oct. 17, 1995 [JP] Japan ..... 7-268294

[51] Int. Cl.[6] ..... B41J 2/01

[52] U.S. Cl. ..... 347/100; 347/103; 347/106; 106/31.13

[58] Field of Search ..... 106/31.13; 347/100, 347/106, 103

[56] References Cited

U.S. PATENT DOCUMENTS

| | | | |
|---|---|---|---|
| 4,689,078 | 8/1987 | Koike et al. | 106/22 |
| 4,702,742 | 10/1987 | Iwata et al. | 8/495 |
| 4,725,849 | 2/1988 | Koike et al. | 346/1.1 |
| 4,849,770 | 7/1989 | Koike et al. | 346/1.1 |
| 4,969,951 | 11/1990 | Koike et al. | 106/22 |
| 5,169,436 | 12/1992 | Matrick | 106/20 D |
| 5,250,121 | 10/1993 | Yamamoto et al. | 106/22 R |
| 5,358,558 | 10/1994 | Yamamoto et al. | 106/22 R |
| 5,549,740 | 8/1996 | Takahashi et al. | 347/100 |

FOREIGN PATENT DOCUMENTS

| | | |
|---|---|---|
| 202656 A2 | 11/1986 | European Pat. Off. . |
| 602914 A1 | 6/1994 | European Pat. Off. . |
| 604105 A1 | 6/1994 | European Pat. Off. . |
| 646460 A1 | 4/1995 | European Pat. Off. . |
| 655527 A1 | 5/1995 | European Pat. Off. . |
| 2318741 | 2/1977 | France . |
| 53-065483 | 6/1978 | Japan . |
| 54-59936 | 5/1979 | Japan . |
| 60-076343 | 4/1985 | Japan . |
| 62-283174 | 12/1987 | Japan . |
| 2-189373 | 7/1990 | Japan . |
| 2-190337 | 7/1990 | Japan . |
| 6-57656 | 3/1994 | Japan . |

OTHER PUBLICATIONS

Patent Abstracts of Japan, vol. 18, NO. 632 (C–1280) with respect to JP 6–240,194 (Dec. 2, 1994).

Derwent Pub. Database, WPI Sec. Ch. Week 9551 AN 95–401193 with respect to JP 7–278,476 of Oct. 24, 1995.

Derwent Pub. Database WPI, Sec. Ch., Week 8728 AN 87–193942 with respect to JP 62–121–776 of Jun. 3, 1987.

Derwent Pub. Database WPI, Sec. Ch., Week 9413 AN 94–107387 with respect to JP 6–57,656 of Mar. 1, 1994.

*Primary Examiner*—Valerie Lund

*Attorney, Agent, or Firm*—Fitzpatrick, Cella, Harper & Scinto

[57] ABSTRACT

Disclosed herein is an ink for ink-jet printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained.

30 Claims, 3 Drawing Sheets

INK FOR INK-JET PRINTING AND THE PRINTING PROCESS THEREWITH

BACKGROUND OF THE INVENTION

1. Field of the Invention

The present invention relates to a composition of an ink for ink-jet printing suitable for use in conducting printing, in particular, on woven or nonwoven fabrics composed of fibers dyable with a disperse dye, and on mixed woven or nonwoven fabrics consisting of these fibers, other synthetic fibers and natural fibers. The present invention also relates to an ink-jet printing process and a transfer printing process using the ink. The present invention further relates to a printed matter, a printing unit, an ink cartridge and a printing apparatus obtained by the processes.

2. Related Background Art

Nowadays, printing is principally conducted by screen printing or roller printing. Both processes are unfit, however, for multi-kind and small-quantity production and difficult to quickly cope with the fashion of the day. Recently, for these reasons, there has been a demand for development of an electronic printing system requiring no printing plates.

In compliance with such demand, many printing processes by ink-jet printing have been proposed. Various fields expect much for such printing processes.

An ink for ink-jet printing that contains a disperse dye is required to have the following performance characteristics:

(1) having good dispersion stability at high temperatures and in storage for a long period of time;

(2) being able to color to a sufficient depth after washing process;

(3) causing no clogging in an ejection nozzle;

(4) undergoing little irregular bleeding and having excellent level dyeing;

(5) undergoing no change in ejection properties and having enough durability for a long period, and, in particular, in the case where an ink ejection system process using the volume change by thermal energy as described in JP-A 54-59936 (the term "JP-A" means Japanese Patent Application Laid-Open), causing no deposition of foreign matter on a heater that gives the thermal energy and securing stable ejection without destruction of the heater caused by cavitation at defoaming; and (6) having good dyeing property and stable reproducibility of color at transfer printing.

In order to satisfy these performance characteristics required, the following means have heretofore been proposed.

First, for the requirement (1), which is important in particular when a water-insoluble or hardly soluble in water dye is used as a disperse dye, such problems are unavoidable that a liquid like an ink-jet ink requiring low viscosity tends to have a poor dispersion stability, compared with conventional liquid disperse dyes and the dye settles at a high temperature or in storage for a long period of time. In order to cope with this problem, JP-A 2-189373 proposes to control the particle size of water-insoluble dye in the ink and also to adjust the solution density in a range between 1.01 and 1.3. This range is too wide, however, to expect satisfactory result for every possible problem. On the other hand, JP-A 2-190337 proposes an ink in which a water-insoluble dye having particles with a diameter of less than 0.2 μm occupies more than 90% in a particle size distribution but no dyes with larger than 0.3 μm diameter is contained, and to adjust the ink viscosity is in a range between 1.1 and 10 mPa·s. Adjustment of these ranges creates a problem or property change due to a high concentration of minute particles resulting in flocculation in storage. It also creates another problem or difficulty in achieving higher depth of color due to viscosity limitation.

In order to cope with the requirement (2), it has been generally conducted to make the concentration of a dye sufficiently high so as to give a satisfactory color depth. This method is an essential means for using ink droplets as minute as 200 pl or less, and for printing on a cloth having a high absorbability. However, such an ink creates a problem of thickening due to evaporation of the ink in a nozzle tip end and also another problem of dye settling, which needs satisfaction of the requirement (3).

As for the requirement (3), it has been conducted to add a polyhydric alcohol such as glycerin. However, this means is not useful in case of water-insoluble or hardly soluble-in water dyes such as disperse dyes; hence this means does not give a satisfactory result except for the case of an extremely specific combination of the dye and solvent.

As for the requirement (4), many proposals have been made. An example is addition of a carboxyl group-containing polymer to an ink as disclosed in JP-A 62-283174. None of them, however, can avoid the problems for the requirements (3) and (5).

With respect to the requirement (5), detailed investigations have not been conducted and therefore a sufficient solution has not been discovered yet although it is pointed out that the structure of dye contained might be one of the causes and also that presence of solvent might conceivably affect breakdown of the dispersion.

With respect to the requirement (6), proposals such as JP-A 53-65483, JP-A 60-76343, and JP-A 6-57656 have been made. Any one of them, according to their descriptions, however, is not able to overcome the difficulty to obtain a high coloring ability and a high productivity when a disperse dye is used in an ink, which is an object of the present invention.

As described above, some means capable of satisfying one of the above requirements may have been able to be found in the prior art. There have not yet been known, however, any printing ink and ink-jet printing process which satisfy all the above-mentioned requirements simultaneously to solve a series of the problems described above.

SUMMARY OF THE INVENTION

It is therefore an object of the present invention to provide an ink and a printing processes, which can simultaneously satisfy the above-mentioned general requirements for conventional printing inks and the ink-jet processes of textile printing on cloth consisting mainly of fibers dyable with a disperse dye: namely, requirement in terms of dyeing for providing printed products having no irregular bleeding but having clear deep color and excellent level dyeing is satisfied; requirement in terms of ejection performance for providing a ink having a good stability and not causing clogging in ink-jet systems including, particularly, a multi-nozzle head system and a thermal energy system is satisfied; requirement in terms of a storage stability in that the dispersion of ink should remain unchanged at a high temperature and during a long-term storage is satisfied; and requirement in terms of transfer printing in that the ink should have superior dyeing property and stable reproducibility is simultaneously satisfied. These objects can be achieved by the present invention described below.

According to the present invention, there is provided an ink for ink-jet printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained.

According to the present invention, there is provided also a method for ink-jet printing comprising the steps of:

providing an ink for ink-jet printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained;

performing ink-jet printing on a cloth containing fiber which can be dyed with a disperse dye; and subjecting the cloth to a thermal treatment.

According to the present invention, there is further provided a method for transfer printing comprising the steps of:

providing an ink for ink-jet printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained;

performing ink-jet printing on a carrier to form an image; and transferring the image to a material comprising a cloth containing fiber which can be dyes with a disperse dye by a thermal treatment.

DETAILED DESCRIPTION OF THE PREFERRED EMBODIMENTS

Figure 1:
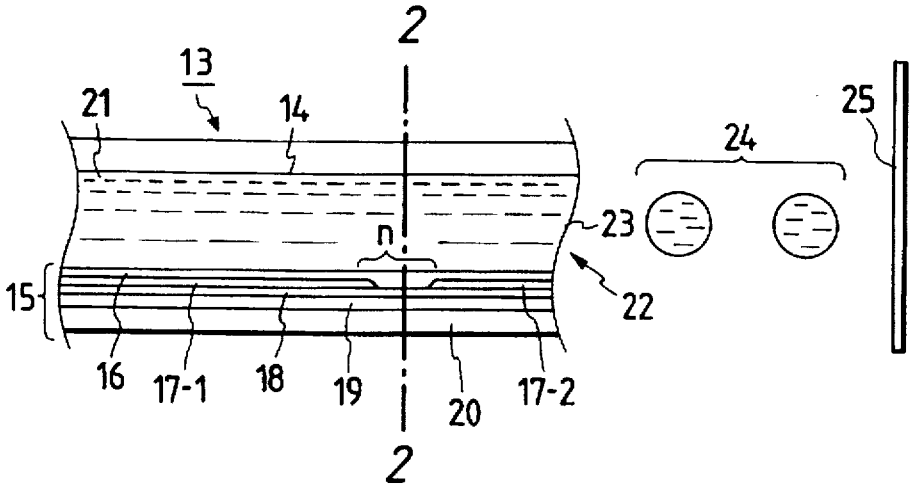
FIG. 1 is a longitudinal cross-sectional view of a head of an ink-jet printing apparatus.

As the result of having conducted improvement in ink-jet printing inks which can simultaneously satisfy above-mentioned various performance requirements, the present inventors have found that substantial improvement in ejection stability, long-term storage stability and bleeding property is attained by use of an ink-jet printing ink containing a disperse dye in 0.1 to 15% by weight, a chemical compound to disperse this disperse dye, water-soluble organic solvent and water, wherein the ink is adjusted to contain the disperse dye having an average particle diameter of in a range of from 150 to 400 nm, having a particle diameter distribution in weight ratio of not more than 85% for the size not exceeding 200 nm, and not substantially containing particles of 1,000 nm or more size and the water-soluble organic solvent contains bishydroxyethylsulfone as an essential component. Observation of the cloth after printing reveals that the prints obtained have no color irregularity, no color shift at mixed color portion; when the cloth is subjected to a thermal treatment, a good reproducibility is realized and the printed product has a sharp outline.

These phenomena relate greatly with a particle size and its distribution of the disperse dye used in the ink. One of storage stability phenomena is a phenomenon of settling, which is theoretically the more difficult to take place with the finer particle size of disperse dye. It cannot be said preferable to adjust an ink-jet printing ink from only this point of view, however, because the control of flocculation requires the larger amount of a dispersing agent, resulting in the higher viscosity. Rather it is likely that it creates problems in many cases when balance with other properties is considered.

The particle size distribution presented in the present invention is consequently an extremely limited range in which both settling and ink properties are compatible with each other.

Regarding the ejection performance, it has been found that an effect of restraining clogging is high in particular in an ink-jet system in which an ink is ejected by making use of heat, or in the case where a head of multi-nozzle type is used. Good effect in the system making use of heat is attributed to the stability of foam at time of foaming. In addition, excellent dispersibility can minimize the lack of uniformity in ejection rate and droplet volume to adjacent nozzles which is attributed to a dispersion breakdown.

Regarding the dyeing property, efficient control of particle size distribution can attain a high color depth, can minimize variation in development of color due to wrong order of ejecting ink droplet of different color in case of printing mixed colors, and can produce good results in dyeing stability and dyeing uniformity also.

Furthermore, the effect of disperse dye particle size distribution in the ink on a higher coloring ability and a dyeing stability is more remarkable in case of transfer printing than in case of direct process printing. The range of disperse dye particle size distribution in the ink according to the present invention is a requirement for obtaining the remarkable effect.

Bishydroxyethylsulfone used as a water-soluble organic solvent in the present invention has a function to restrain an ink viscosity build-up and to elevate a dispersion stability of the disperse dye.

Now, the present invention is explained in more details by preferred manners of embodiments.

The ink used in the present invention is characterized in that the average particle diameter of disperse dye and its distribution are adjusted. The range of average particle diameter is from 150 to 400 nm, preferably from 160 to 350 nm. With the average particle diameter less than 150 nm, flocculation tends to easily take place resulting in great change in physical properties during storage. It is also likely in many cases that larger surface area per one unit weight of dye requires a larger amount of a dispersing agent necessary for dispersion, resulting in a viscosity build-up which affects an ejection property adversely. On the other hand, in the case of an average particle size diameter larger than 400 nm, settling in storage is remarkable creating a problem of a long-term ejection property. This tendency is a serious problem especially in case of an ink-jet. system utilizing thermal energy.

Regarding the particle size distribution, change in the physical properties due to flocculation during storage becomes greater when a proportion of dye having a particle size of less than 200 nm exceeds 85% by weight. It is also likely that the amount of dispersing agent used becomes larger, and reduction in ink viscosity indispensable for ink-jet printing is difficult to be attained. In order to lower the viscosity in this case, a content of the disperse dye must be lowered and consequently a high coloring ability cannot be achieved.

On the other hand, an ink system containing substantially no particles of larger than 1,000 nm is required because, otherwise, problems such as settling, clogging and the like become noticeable; the term "containing substantially no particles of larger than 1,000 nm" herein used in the present invention implies that a proportion of the dye having a particle size of not less than 1,000 nm is not more than 2% by weight, preferably not more than 1% by weight.

Filtration through a filter of, for example, less than 1 μm or centrifugal separation is effective as a means to remove these particles.

An average particle size and a particle size distribution can be measured by ELS-800 (trade name, manufactured by OHTSUKA DENSI Company), an apparatus by scattered laser method using a cell of 3 mm×3 mm at a number of cumulation of 200.

A printing ink according to the present invention is an ink-jet ink for printing that comprises a disperse dye, water-soluble organic solvent including bishydroxyethyl-sulfone and water.

Followings, though not limited to, are preferable as the a disperse dye described in the present invention:

C.I. DISPERSE YELLOW 5, 42, 54, 64, 79, 82, 83, 93, 99, 100, 119, 122, 124, 126, 160, 184:1, 186, 198, 199, 204, 211, 224 and 237; C.I. DISPERSE ORANGE 13, 29, 31:1, 33, 49, 54, 55, 66, 73, 118, 119 and 163; C.I. DISPERSE RED 54, 72, 73, 86, 88, 91, 92, 93, 111, 126, 127, 134, 135, 143, 145, 152, 153, 154, 159, 164, 167:1, 177, 179, 181, 204, 206, 207, 221, 239, 240, 258, 277, 278, 283, 288, 311, 323, 343, 348, 356 and 362; C.I. DISPERSE VIOLET 26, 33, 77; C.I. DISPERSE BLUE 56, 60, 73, 79, 79:1, 87, 87:1, 113, 128, 143, 148, 154, 158, 165, 165:1, 165:2, 176, 183, 185, 197, 198, 201, 214, 224, 225, 257, 266, 267, 287, 354, 358, 365 and 368; and C.I. DISPERSE GREEN 6:1 and 9.

The content of the dye (total content when two or more dyes are used) is within a range of from 0.1 to 15% by weight, preferably from 0.5 to 10% by weight, more preferably from 1 to 8% by weight on the basis of the total weight of ink. When the content of disperse dye is not more than 0.1% by weight, the color depth is insufficient. The content not less than 15% by weight may cause poor storability, increase of viscosity or deposition due to evaporation of ink near the nozzle tip incurring blockage of the delivery; however, control of the particle size within the range of the present invention might be difficult.

A compound that disperses a disperse dye may be a so-called dispersant, a surfactant, a resin or the like. The dispersants and surfactants may be either anionic or non-ionic.

Examples of the anionic compounds include fatty acid salts, salts of alkyl sulfates, alkyl benzene sulfonates, alkyl naphthalene sulfonates, dialkyl sulfosuccinic acid salts, salts of alkyl phosphate esters, naphthalene sulfonic acid-formalin condensates, polyoxyethylene alkyl sulfate esters, and substituted derivatives of these compounds.

Examples of the nonionic compounds include polyoxyethylene alkyl ethers, polyoxyethylene alkyl phenyl ethers, polyoxyethylene fatty acid esters, sorbitan fatty acid esters, polyoxyethylene sorbitan fatty acid esters, polyoxyethylene alkyl amines, glycerin fatty acid esters, oxyethylene oxypropylene block polymers, acetylene glycol and its ethylene oxide adducts, and substituted derivatives of these compounds.

Among them, formalin condensates of naphthalene sulfonic acid and their derivatives (particularly alkylated compounds), acetylene glycol and its ethylene oxide adducts are preferred in particular.

Examples of the resins include block copolymers, random copolymers and graft copolymers as well as salts of these formed from at least two monomers (at least one of these monomers is hydrophilic) selected from the group consisting of styrene and its derivatives, vinyl naphthalene and its derivatives, aliphatic alcohol esters of α,β-unsaturated carboxylic acids, acrylic acid and its derivatives, maleic acid and its derivatives, itaconic acid and its derivatives, fumaric acid and its derivatives, vinyl acetate, vinyl alcohol, vinyl pyrrolidone, and acrylamide and its derivatives.

Preferably, these resins are alkali-soluble resins soluble to solutions of a base. Among them, water-soluble polymer compounds having carboxyl groups and their salts are particularly preferred.

A compound that disperses a disperse dye is preferably contained in an amount within a range of from 0.02 to 30% by weight based on the total weight of the ink, more preferably from 0.05 to 25% by weight.

The ink according to the present invention contains water as the principal component within a range of from 10 to 93% by weight, preferably from 25 to 87% by weight, more preferably from 30 to 82% by weight on the basis of total weight of the ink. The content of bishydroxyethylsulfone is within a range of from 2 to 40% by weight, preferably from 5 to 30% by weight, more preferably from 10 to 25% by weight on the basis of the total weight of the ink.

Furthermore, the effect of the present invention can be more significant by using other water-soluble organic solvents. Examples such solvent include monohydric alcohols such as methanol, ethanol, and isopropyl alcohol; ketones or ketoalcohols such as acetone, and diacetone alcohol; ethers such as tetrahydrofuran and dioxane; addition polymers of oxyethylene or oxypropylene such as diethylene glycol, triethylene glycol, tetraethylene glycol, dipropylene glycol, tripropylene glycol, polyethylene glycol, and polypropylene glycol; alkylene glycols the alkaline moiety of which has 2 to 6 carbon atoms, such as ethylene glycol, propylene glycol, trimethylene glycol, butylene glycol, hexylene glycol ;triols such as 1,2,6-hexyanetriol; thiodiglycol; glycerin; lower alkyl ethers of polyhydric alcohols, such as ethylene glycol monomethyl (or monoethyl) ether, diethylene glycol monomethyl (or monoethyl) ether, triethylene glycol monomethyl(or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; 2-pyrrolidone; and 1,3-dimethyl-2-imidazolidinone. The content of the water-soluble organic solvents is generally within a range of from 1 to 50% by weight, preferably from 2 to 45% by weight on the basis of the total weight of the ink.

Although the water-soluble organic solvent described above may be used either alone or as a mixture, preferable water-soluble organic solvents are monohydric alcohols, ketones, glycerin, ethylene glycol, diethylene glycol, triethylene glycol, tetraethylene glycol, thiodiglycol, propylene glycol, dipropylene glycol, tripropylene glycol and their derivatives, in particular, their alkyl ethers.

Although the principal components of the inks according to the present invention are as described above, various kinds of other additives such as antifoaming agents, viscosity modifiers, surface tension modifiers, pH adjustors may also be added as required. Of these, the use of urea and derivatives thereof, carboxylic acid up to three valences and salts thereof, and phosphoric acid and derivatives thereof may result in more significant effects of the present invention.

The inks according to the present invention may be produced by the dispersing methods and mixing methods which are broadly known, using the disperse dyes described above, the compounds that disperse the disperse dyes, solvents, water, and other additives.

As for the physical properties of the ink, the viscosity is within a range of from 2 to 10 mPa·s, preferably from 2 to 8 mPa·s, more preferably from 2 to 6 mPa·s, and the surface tension is preferably within a range of from 30 to 50 dyn/cm.

The material comprising the cloth used in the present invention may be a cloth in common with a direct printing and a transfer printing by means of the ink jet system, and contains fibers which can be dyed with disperse dyes. Among these, the materials containing polyester, acetate and triacetate are preferred. In particular, the material containing polyester is preferred.

The fibers described above may be used in any form of woven fabric, knit fabric and nonwoven fabric.

Such cloths preferably consist of 100% of fibers which can be dyed with disperse dyes. However, if the mixing rate is 30% or more, preferably 50% or more, blended yarn woven fabric or blended yarn nonwoven fabric may be used as the cloth for the textile printing according to the present invention, when these blended fabrics are in mix with fibers that can be dyed with disperse dyes. Examples of such fibers include rayon, cotton, polyurethane, acryl, nylon, wool, and silk.

The thickness of the yarn comprising such cloths is preferably within a range of from 10 to 100 denier. Although no particular limitation is imposed on the thickness of the fibers comprising the yarn, the effects of the present invention is greater if the fiber is not more than 1 denier.

The cloths for the ink jet textile printing described above more preferably contain 0.01 to 20% by weight of at least one substance selected from the group consisting of water-soluble metal salts, water-soluble polymers, urea, thiourea and surfactants, on the basis of the weight of the dried cloth. Containing these substances is particularly necessary in many cases of a direct printing by means of the ink-jet system. The total content of those substances is preferably within a range of from 0.5 to 18% by weight, more preferably 1 to 15% by weight. If the content is less than 0.01% by weight, adding these substances does not produce any effect, and the content not less than 20% by weight may not be preferable in view of transporting and dyeing the cloth.

Examples of the water-soluble polymers include natural water-soluble polymers including starches from corn, wheat and the like; celluloses such as carboxymethyl cellulose, methyl cellulose and hydroxymethyl cellulose; polysaccharaides such as sodium alginate, gum arabic, locust bean gum, tragacanth gum, guar gum and tamarind seed; proteins such as gelatin and casein; tannin and its derivatives; and lignin and its derivatives.

As for the water-soluble synthetic polymers, the examples include polyvinyl alcohol type compounds, polyethylene oxide type compounds, water-soluble acrylic polymers, and water-soluble maleic anhydride polymers. Among these, the polysaccharide polymers and cellulose polymers are preferred.

Examples of the water-soluble metal salts include compounds that form a typical ionic crystal and have a pH of from 4 to 10 such as halides of alkali metals and alkaline earth metals. Representative examples of such compounds include NaCl, $Na_2SO_4$, KCl and $CH_3COONa$ for alkali metal salts, and $CaCl_2$ and $MgCl_2$ for alkaline earth metal salts. Among these, salts of Na, K and Ca are preferred.

As the sufactant, any of anionic type, cationic type, amphoteric type and nonionic type surfactants may be used. Representative examples include; anionic surfactans such as higher alcohol sulfates, sulfonate of naphthalene derivatives; cationic surfactants such as quaternary ammonium salts; amphoteric surfactants such as imidazoline derivatives; and nonionic surfactants such as polyoxyethylene alkyl ethers, polyoxyethylene propylene block polymers, sorbitan fatty acid esters, polyoxyethylene sorbitan fatty acid esters and ethylene oxide adducts of acetylene alcohol.

The moisture regain of the cloth used in the present invention is preferably within a range of from 1.0 to 101.0%, more preferably from 3.0 to 81.0%. When the water content is less than 1.0%, bleeding might not be sufficiently prevented and color development might be unsatisfactory. When the moisture regain is more than 101.0%, transportation might be problematic; in particular, bleeding might be a problem.

The moisture regain of the cloth is measured by referring to JIS L 1019. Namely, the sample in amount of 100 g is weighed precisely, placed in a dryer kept at 105±2° C. and subjected to drying until becoming a constant weight. Thereafter the sample is washed with water, and subjected to drying again until becoming a constant weight. And then, only the fiber portion after the drying is weighed, and the moisture regain of the cloth is calculated with the following equation:

$$\text{Moisture regain (\%)}=\{(W-W')/W''\}\times 100$$

wherein W is the weight before the drying, W' is the weight after the drying, and W" the weight after the water washing and drying.

In the carrier used in transfer printing, as a sheet base may be used paper, cloth, glass, film, metal, or the like; all of these may be used without special treatment. In particular, paper made from Kraft pulp or grind pulp is preferred. The preferable weight ranges from 40 to 120 g/m$^2$, and the preferable thickness ranges from 0.02 to 0.4 mm.

When a large amount of ink is applied, the sheet base may be subjected to the treatment similarly applied to the cloth; that is, a water soluble metal salt, a water soluble polymer, urea, thiourea, or a surfactant may be applied in similar conditions.

In addition, use of a transfer vanish or a remover varnish on the sheet base is also convenient. Examples of the transfer vanish to be used include rosin modified phenolic resin, rosin modified maleic acid resin, polyamide, polystyrene, xylene resin and polyacrylate.

Examples of the remover varnish include nitrocellulose, ethylcellulose, polyethylene glycol, polypropylene glycol, cellolose and acetate-propionate.

The ink-jet printing system according to the present invention may be any one of conventionally known systems; for example, one of most effective is disclosed in JP-A 54-59936, wherein thermal energy is applied to an ink so as to undergo rapid volume change, and the ink is ejected from a nozzle by action force caused by this change of state. The system mentioned above is applied, in most cases, to printing heads having a multi-nozzle, where irregularity of the ink ejection speed among the nozzles is small and the speed is within a range of 5 to 20 m/sec; thereby, the ink according to the present invention performs most effectively. The penetration of ink droplet to fiber is most suitable when the ink containing the disperse dye impinges on cloth at this speed.

When the ink according to the present invention is used in such manner, stable printing free of clogging is possible for a long period of time without causing deposition of foreign matter on a heater and disconnection.

The conditions for realizing most efficient printing by use of the ink according to the present invention are preferably that an ejecting droplet is from 20 to 200 pl; a shot-in ink quantity is 4 to 40 nl/mm$^2$; a driving frequency is not less than 1.5 kHz; and a head temperature is from 35°to 60° C.

An example of suitable devices for printing using the ink according to the present invention is a device in which thermal energy corresponding to printing signals is applied to an ink within a printing head, and ink droplets are generated by the thermal energy. Now, this device is explained in more details.

Figure 2:
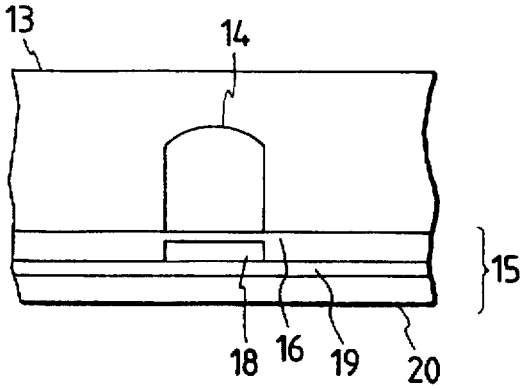
FIG. 2 is a transverse cross-sectional view of a head of an ink-jet printing apparatus.
Figure 3:
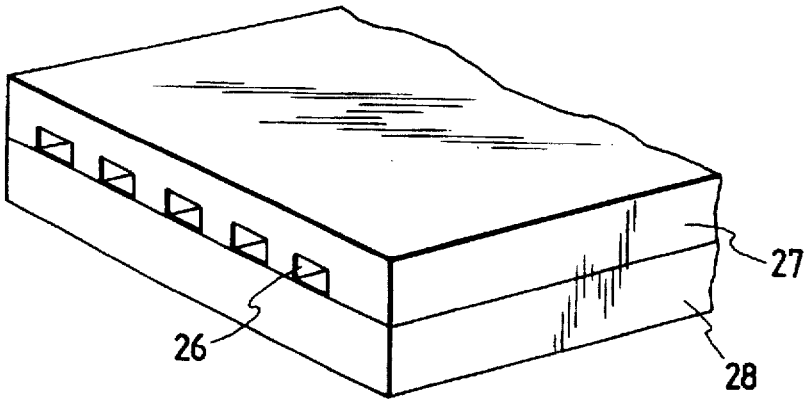
FIG. 3 is a perspective view of a multi-head which is an array of such heads as shown in FIG. 1.

Examples of the structure of an head, which is a main component of such a device, are illustrated in FIGS. 1, 2 and 3.

A head 13 is formed by bonding a glass, ceramic or plastic plate or the like having a groove 14 to which ink is passed to a heating head 15 (not limited to head regardless of the figures) used in thermal printing. The heating head 15 is composed of a protective film 16 formed of silicon oxide or the like, aluminum electrodes 17-1 and 17-2, a heating resistor layer 18 formed of nichrome or the like, a heat accumulating layer 19, and a substrate 20 made of alumina or the like having a good heat radiating property.

An ink 21 comes up to an ejection orifice 22 (a minute opening) and forms a meniscus 23 due to a pressure P.

Now, upon application of electric signals to the electrodes 17-1 and 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the orifice 22 to a cloth 25 in the form of printing droplets 24. FIG. 3 illustrates an appearance of a multi-head composed of an array of a number of heads as shown in FIG. 1. The multi-head is formed by closely bonding a glass plate 27 having a number of grooves 26 to a heating head 28 similar to the head illustrated in FIG. 1. FIG. 1 is a longitudinal cross-sectional view of the head 13 along ink passage and FIG. 2 a transverse cross-section at 2—2 of FIG. 1.

Figure 4:
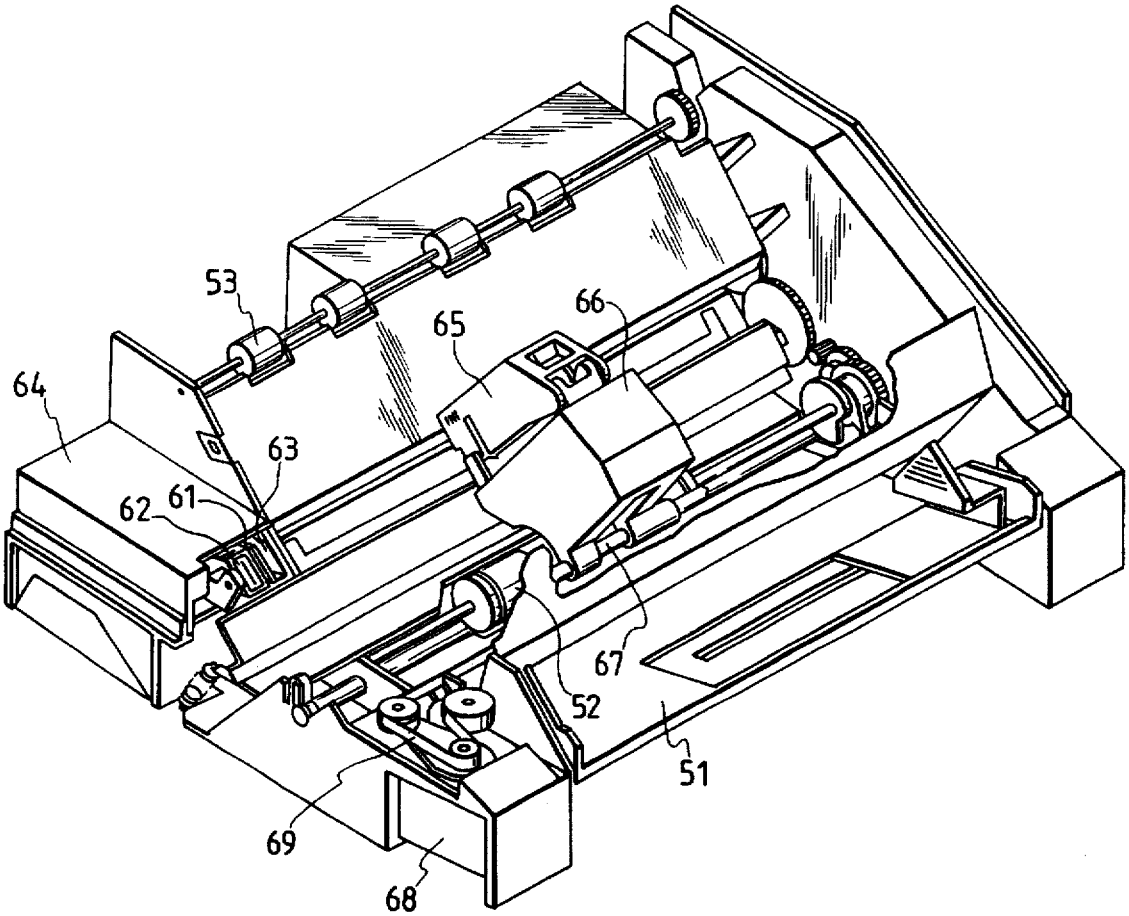
FIG. 4 is a perspective view of an illustrative ink-jet printing apparatus.

FIG. 4 illustrates an example of an ink-jet. printing apparatus in which such a head has been incorporated.

In FIG. 4, reference numeral 61 designates a blade serving as a wiping member, one end of which is a stationary end held by a blade-holding member to form a cantilever. The blade 61 is provided at the position adjacent to the region in which a printing head operates, and in this embodiment, is held in such a form that it protrudes into the course through which the printing head moves. Reference numeral 62 indicates a cap, which is provided at the home position adjacent to the blade 61, and is so constituted that it moves in the direction perpendicular to the direction in which the printing head moves, and comes into contact with the face of ejection openings to cap it. Reference numeral 63 denotes an absorbing member provided adjoiningly to the blade 61 and is held, like the blade 61, in such a form that it protrudes to the course through which the printing head moves. The above-described blade 61, cap 62 and absorbing member 63 constitute an ejection-recovery portion 64. The blade 61 and absorbing member 63 remove off water, dust and/or the like from the face of ink-ejecting openings.

Reference numeral 65 designates the printing head having an ejection-energy-generating means and serving to eject the ink onto the cloth set in an opposing relation to the ejection opening face provided with ejection openings to conduct printing. Reference numeral 66 indicates a carriage on which the printing head 65 is mounted so that the printing head 65 can move. The carriage 66 is slidably interlocked with a guide rod 67 and is connected at its part to a belt 69 driven by a m otor 68. Thus, the carriage 66 can move along the guide rod 67 and hence, the printing head 65 can move within a printing region and from the region to a region adjacent thereto.

Reference numeral 51 is a cloth feeding part from which the cloths are sep arately inserted, and reference numeral 52 cloth feed rollers driven by a motor though not illustrated. With such a construction, the cloth is fed to the position opposite to the ejection opening face of the printing head, and discharged from a cloth discharge section provided with cloth discharge rollers 53 with the progress of printing.

In the above construction, the cap 62 in the head recovery portion 64 is receded from the path of motion of the printing head 65 when the printing head 65 returns to its home position, for example, after completion of printing, and the blade 61 remains protruded into the path of mot ion. As a result, the ejection opening face of the printing head 65 is wiped. When the cap 62 comes into contact with the ejection opening face of the printing head 65 to cap it, the cap 62 moves so as to protrude into the path of motion of the printing head.

When the printing head 65 moves from its home position to the position at which printing starts, the cap 62 and the blade 61 are at the same positions as the positions for the wiping as described above. As a result, the ejection opening face of the printing head 65 is also wiped at the time of this movement.

The above movement of the printing head to its home position is made not only when the printing is completed or the printing head is recovered for ejection, but also when the printing head moves between printing regions for the purpose of printing, during which it moves to the home position adjacent to each printing region at given intervals, where the ejection opening face is wiped in accordance with this movement.

Figure 5:
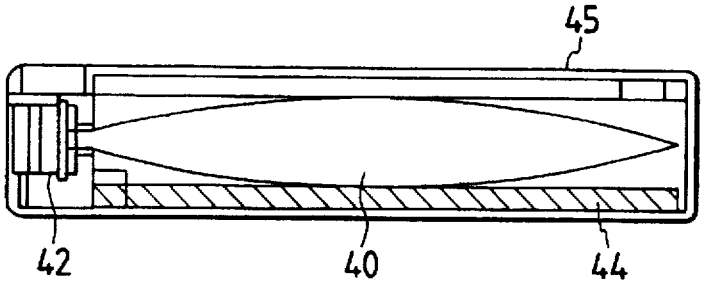
FIG. 5 is a longitudinal cross-sectional view of an illustrative ink cartridge.

FIG. 5 shows an exemplary ink cartridge 45 in which ink is held. Ink is fed to the head through an ink-feeding member, for example, a tube. Here, reference numeral 40 shows an ink container portion containing the ink to be fed, as exemplified by an ink bag. One end thereof is provided with a stopper 42 made of rubber. Insertion of a needle (not illustrated) into this stopper 42 makes it possible for the ink in the ink bag 40 to be fed to the head.

Reference numeral 44 shows an ink-absorbing member for receiving a waste ink. In the present invention, it is preferable that the ink container portion should be formed of polyolefin, in particular, polyethylene, at its surface with which the ink comes into contact. Ink-jet printing units usable in the present invention are not limited to one in which a head and an ink cartridge are separately installed as described above. A device in which these members are integrally formed as shown in FIG. 6 may also be satisfactorily used.

Figure 6:
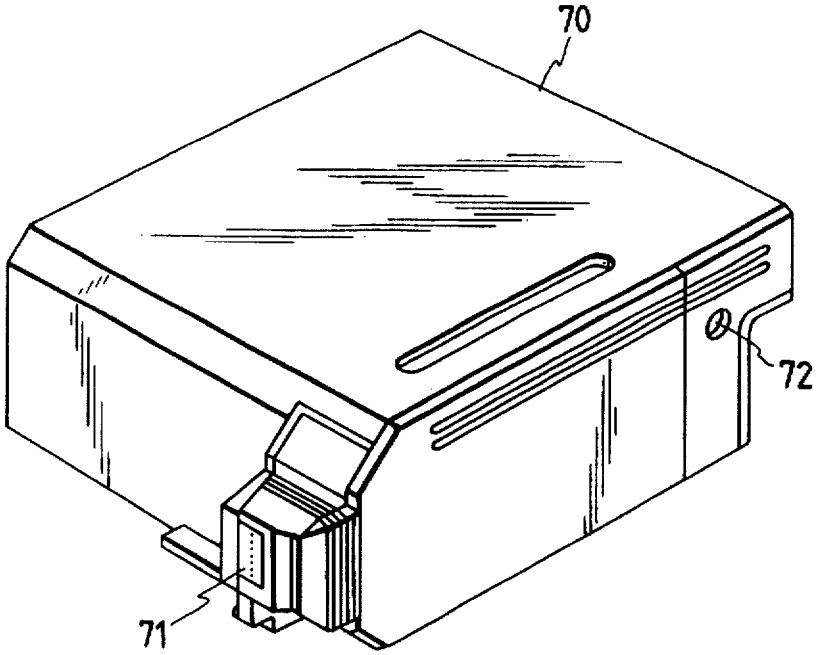
FIG. 6 is a perspective view of an illustrative printing unit.

In FIG. 6, reference numeral 70 designates a printing unit, in the interior of which an ink container portion containing ink, for example, an ink-absorbing member, is contained. The printing unit 70 is so constructed that the ink in such an ink-absorbing member is ejected in the form of ink droplets through a head 71 having a plurality of orifices. In the present invention, polyurethane is preferably used as a material for the ink-absorbing member. Reference numeral 72 designates an air passage for communicating the interior of the printing unit with the atmosphere. This printing unit 70 can be used in place of the printing head shown in FIG. 4, and is detachably installed on the carriage 66.

The printing ink used in the present invention is applied onto a cloth as described above. However, the ink only adheres to the cloth in this state. Accordingly, the cloth must be subsequently subjected to a process for reactively fixing the dye in the ink to the fibers and a process for removing an unreacted dye. Such reactive fixing may be conducted by an HT steaming process or a thermosol process with remarkable effect of the present invention. In case of the HT steaming process it is desirable to treat the cloth at temperature between 140° C. and 180° C. for 2 to 30 minutes; preferably at temperature between 160° C. and 180° C. for 6 to 8 minutes. In case of the thermosol process it is desirable to treat the cloth at temperature between 160° C. and 210° C. for 10 seconds to 5 minutes; preferably at temperature between 180° C. and 210° C. for 20 seconds to 2 minutes. Subsequent washing may be conducted by a publicly known soaping process, preferably by reduction process washing.

Transfer conditions of copy printing are to have both ink-fed carriers and a cloth to be dyed contacted with pressure and then to heat-treat them at 160 to 230° C., preferably at 180°to 220° C. for 2 to 60 seconds, preferably for 3 to 40 seconds. Steaming process conducted for direct printing as described above may further be added. Treatments after washing are the same as those of direct printing.

The cloth subjected to the above-described treatments is then cut into desired sizes, and the cut pieces are subjected to processes required to obtain final processed articles, such as sewing, bonding and/or welding, so that apparel such as one-pieces, dresses, neckties or bathing suits, bed covers, sofa covers, handkerchiefs, curtains, or the like may be obtained.

Methods in which a cloth is processed by sewing and/or the like to obtain apparel or other daily needs are described in many known books, for example, "Saishin Nitto Hosei Manual" (The Newest Knitting and Sewing Manual), published by Sen-i Journal Co.; a monthly magazine, "Soen", published by Bunka Shuppan Kyoku; etc.

The present invention will hereinafter be described more specifically by the following Examples and Comparative Examples. All designations of "part" or "parts" and "%" in the following examples mean part or parts by weight and % by weight unless expressly noted.

Preparation of Cloth (A)

An 100% polyester cloth of plain weave composed of 20 denier yarn spinned from 0.7 denier fibers was immersed preliminarily in an aqueous solution containing 10% of urea and 1% of carboxymethyl cellulose, dehydrated at a pickup of 60% and dried; thereby the moisture regain of the cloth was adjusted to 6%.

Preparation of Cloth (B)

A woven fabric comprising a mixed yarn of 30 denier composed of 85% of polyester fiber and 15% of Egyptian cotton was immersed preliminarily in an aqueous solution containing 2% of sodium chloride and 2% of sodium alginate carboxymethyl cellulose preliminarily, dehydrated at a pickup of 60% and dried; thereby the moisture regain of the cloth was adjusted to 9%.

Preparation of disperse dye solutions (I to VII)

A solution was prepared by mixing:

20 parts of a condensation product of naphthalenesulfonic acid and formaldehyde, 5 parts of sodium lignin sulfonate, 55 parts of ion-exchanged water, and 10 parts of ethylene glycol.

To this solution, 10 parts of a disperse dye is added respectively and subjected to premixing for 30 minutes. Thereafter, dispersion treatment was made by a sand grinder (manufactured by Igarashi Kikai) using zirconium beads (1 mm diameter) as the pulverizing media with a fill factor of 50%. Disperse dye solutions I to VII were obtained with additional conditions mentioned below.

| | |
|---|---|
| Disperse dye solutions (I) | |
| Disperse dye | C.I. Disperse Yellow 224 |
| Pulverizing period | 3 hours |
| Final filtration | Use of an 1 μm pore filter |
| Disperse dye solutions (II) | |
| Disperse dye | C.I. Disperse Red 152 |
| Pulverizing period | 3 hours |
| Final filtration | Use of an 1 μm pore filter |
| Disperse dye solutions (III) | |
| Disperse dye | C.I. Disperse Blue 60 |
| Pulverizing period | 3 hours |
| Final filtration | Use of an 1 μm pore filter |
| Disperse dye solutions (IV) | |
| Disperse dye | C.I. Disperse Blue 60 |
| Pulverizing period | 10 hours |
| Final filtration | Use of an 1 μm pore filter |
| Disperse dye solutions (V) | |
| Disperse dye | C.I. Disperse Blue 60 |
| Pulverizing period | 1 hour |
| Final filtration | Use of an 1 μm pore filter |
| Disperse dye solutions (VI) | |
| Disperse dye | C.I. Disperse Blue 60 |
| Pulverizing period | 7 hours |
| Final filtration | Use of a 0.45 μm pore filter |
| Disperse dye solutions (VII) | |
| Disperse dye | C.I. Disperse Blue 60 |
| Pulverizing period | 3 hours |
| Final filtration | Without filtration |

Preparation of Ink (a):

| | |
|---|---|
| Disperse dye solutions (I) above | 30 parts |
| Thiodiglycol | 10 parts |
| Bishydroxyethylsulfone | 4 parts |
| Diethyleneglycol | 5 parts |
| 2,4,7,9-tetramethyl-5-decyne-4,7-diol | 0.05 parts |

-continued

| | |
|---|---|
| Urea | 2 parts |
| Ion-exchanged water | 48.9 parts |

After all the above components were mixed, the resultant mixture was adjusted to pH 8 with sodium hydroxide and stirred for 2 hours; thereafter, the solution was filtered with an 1 μm pore filter. Thus, ink-jet printing Ink (a) according to the present invention was obtained. The physical properties of resulting ink-jet printing Ink (a) are shown in Table 1.

Ink-jet printing Ink (a) obtained in this way was charged to Color Bubble Jet Printer BJC600 (Tradename, manufactured by Canon Inc.); then, solid printing was made on the above Cloths (A) and (B) to make each three samples of 10 cm×5 cm with portions of printing densities of 100% and 200%. Thereafter, fixation was made by steaming at 180° C. for 8 minutes.

Then, the treated cloths were washed water and subjected to reduction cleaning. The colored product was evaluated in terms of bleeding, color stability and level dyeing. The results, shown in Table 2, were excellent.

In addition, solid printing for continuous 10 hours was made by the printer mentioned above; ejection stability before and after the continuous printing was evaluated; the result was very stable, that is, no change was observed for the ejection before and after the continuous printing as shown in Table 2. This sedimented little after storing at a high temperature (50° C., one week) and for a long period (normal temperature, three months); agitation again brought substantially no change in the physical properties when the viscosity and surface tension were measured.

EXAMPLE 2

| Preparation of Ink (b): | |
|---|---|
| Disperse dye solutions (II) above | 40 parts |
| Thiodiglycol | 8 parts |
| Bishydroxyethyl sulfone | 5 parts |
| Glycerol | 5 parts |
| Ethylene oxide adduct of 2,4,7,9-tetramethyl-5-decyne-4,7-diol (n = 3.5) | 0.1 parts |
| Urea | 2 parts |
| Ion-exchanged water | 40 parts |

After all the above components were mixed, the resultant mixture was adjusted to pH 8 with sodium hydroxide and stirred for 2 hours; thereafter, the solution was filtered with an 1 μm pore filter. Thus, ink-jet printing Ink (b) according to the present invention was obtained. Measurement and evaluation were made in the same way as for the ink of Example 1.

All the results were excellent as shown in Table 2.

EXAMPLE 3

| Preparation of Ink (c): | |
|---|---|
| Disperse dye solutions (III) | 35 parts |
| Thiodiglycol | 6 parts |
| Bishydroxyethylsulfone | 10 parts |
| Ethanol | 1 parts |

-continued

| Preparation of Ink (c): | |
|---|---|
| Ethylene oxide adduct of 2,4,7,9-tetramethyl-5-decyne-4,7-diol (n = 3.5) | 0.1 parts |
| Urea | 2 parts |
| Ion-exchanged water | 46.9 parts |

After all the above components were mixed, the resultant mixture was adjusted to pH 8 with sodium hydroxide and stirred for 2 hours; thereafter, the solution was filtered with an 1 μm pore filter. Thus, ink-jet printing Ink (c) according to the present invention was obtained. Measurement and evaluation were made in the same way as for the ink of Example 1. All the results were excellent as shown in Table 2.

Comparative Example 1

The same procedures as Example 3 were repeated except Disperse dye solutions (III) was replaced by Disperse dye solutions (IV); thereby obtaining Ink (d) for the purpose of comparison. The results of measurement and evaluation are shown in Tables 1 and 2. While the initial performance was relatively good, the change of physical properties during storage was large; the change of ejection due to storage was confirmed to be a problematic level.

Comparative Example 2

The same procedures as Example 3 were repeated except Disperse dye solutions (III) was replaced by Disperse dye solutions (V); thereby obtaining Ink (d) for the purpose of comparison. The results of measurement and evaluation are shown in Tables 1 and 2. While the initial performance was relatively good, the change of physical properties during storage was large; the change of ejection due to storage was confirmed to be a problematic level. The sedimentation during storage was large making the handling difficult.

Comparative Example 3

The same procedures as Example 3 were repeated except Disperse dye solutions (III) was replaced by Disperse dye solutions (V); thereby obtaining Ink (e) for the purpose of comparison. The results of measurement and evaluation are shown in Tables 1 and 2. While the initial performance was relatively good, the change of physical properties during storage was large; the change of ejection due to storage was confirmed to be a problematic level.

Comparative Example 4

The same procedures as Example 3 were repeated except that Disperse dye solutions (III) was replaced by Disperse dye solutions (VII) and that the filtration was not made at the step of making the ink; thereby obtaining Ink (g) for the purpose of comparison. The results of measurement and evaluation are shown in Tables 1 and 2. Dyeing characteristic and clogging were problems. The ejection characteristic for a long period was at a level of problem. The sedimentation during storage was large making the handling difficult.

EXAMPLE 4

Inks (a), (b) and (c) were charged to Color Bubble Jet Printer BJC600 (Tradename, manufactured by Canon Inc.); then, various mixed color printings were made on Cloths (A) and (B), in which printing densities of each ink is 50 to 100% and the order of printing was varied. Then, steaming was applied at 180° C. for 6 or 8 minutes. The treated clothes were washed water and subjected to reduction cleaning, and the printed images were evaluated.

The colors were stabilized excellently with stable hue regardless of the printing order; the steamings for 6 minutes and for 8 minutes resulted in same way.

Comparative Examples 5 to 8

Example 4 was repeated except Inks (d), (e), (f) and (g) were used in place of Ink (c). Only the parts where Inks (d), (e), (f) and (g) were involved were definitely deteriorated in comparison with Example 4 in terms of color stability brought by different printing orders and different steaming period.

EXAMPLE 5

Inks (a), (b) and (c) were charged to Color Bubble Jet Printer BJC600 (Tradename, manufactured by Canon Inc.); then, various mixed color printings were made on transfer papers (60 g/m$^2$, 0.2 mm thickness) made of Kraft pulp, in which printing densities of each ink is 50 to 100% and the order of printing was varied. Then, the papers were adhered on Cloths (A) and (B) under pressure; the wholes were subjected to steaming at 200° C. for 20 seconds or 30 seconds, water washing, reduction cleaning, and the printed images were evaluated. The colors were stabilized excellently with stable hue regardless of the printing order; the steamings for 20 seconds and for 30 seconds resulted in same way.

Comparative Examples 9 to 12

Example 5 was repeated except Inks (d), (e), (f) and (g) were used in place of Ink (c). Only the parts where Inks (d), (e), (f) and (g) were involved were definitely deteriorated in comparison with Example 5 in terms of color stability brought by different printing orders and different steaming period.

According to the inks for ink-jet printing of the present invention, as described above; problems relating to dyeing are solved giving printed products free of irregular bleeding on clothes and uniform level dyeing; problems relating to color stability are solved giving printed products of excellent level dyeing and color stability; problems relating to ejection performance are solved giving, in particular, excellent ejection performance in ink-jet by thermal energy; problems relating to storage stability are solved giving stable inks that have stabilized dispersion at a high temperature for a long period; and, in addition, all these problems are solved simultaneously.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

TABLE 1

| | Ink | Viscosity (mPa · s) | Surface tension (dyn/cm) | Average particle diameter (nm) | Weight ratio (<200 nm) (%) | Presence of particles (>1000 nm) |
|---|---|---|---|---|---|---|
| Ex. 1 | a | 2.5 | 44 | 210 | 75 | No |
| Ex. 2 | b | 3.0 | 43 | 230 | 60 | No |
| Ex. 3 | c | 2.8 | 42 | 190 | 84 | No |
| Comp. Ex. 1 | d | 3.0 | 44 | 140 | 91 | No |
| Comp. Ex. 2 | e | 2.7 | 41 | 410 | 30 | No |
| Comp. Ex. 3 | f | 3.0 | 44 | 180 | 95 | No |
| Comp. Ex. 4 | g | 2.8 | 42 | 210 | 85 | Yes |

TABLE 2

| | Ink | Bleeding *1 | Level dyeing *2 | Color stability *3 | Ejection stability *4 | Storability: Sediment *5 | Storability: PP. *7 Change *6 |
|---|---|---|---|---|---|---|---|
| Ex. 1 | a | E | E | E | E | E | E |
| Ex. 2 | b | E | E | E | E | F | E |
| Ex. 3 | c | E | E | E | E | E | E |
| Comp. Ex. 1 | d | E | P | F | P | E | P |
| Comp. Ex. 2 | e | P | B | P | B | P | E |
| Comp. Ex. 3 | f | E | P | F | E | E | P |
| Comp. Ex. 4 | g | P | P | P | B | P | F |

Remarks:

*1 Irregularity at the straight part of edge was visually observed and evaluated.

E (Excellent): No irregularity at all

F (Fair): Some irregularity

P (Poor): Much irregularity

*2 Ten portions of 100% solid printing part were measured for K/S values, and the dispersion to the mean value was evaluated.

E (Excellent level dyeing): The dispersions of K/S values at all portions were less than 0.5.

P (Poor level dyeing): In one or more portions, the dispersion of K/S values was not less than 0.5.

B (Bad or very poor level dyeing): The dispersions of K/S values at all portions were not less than 0.5.

$K/S = (1 - R)^2/2R$

R: Reflectance at a maximum absorption wavelength

*3 K/S values after coloring in 100% solid printing part of three cloths were measured; the evaluation was based on a ratio of the maximum value to the minimum value.

E (Excellent): 0.98 or higher

F (Fair): Not less than 0.95 and less than 0.98

P (Poor): Less than 0.95

*4 An ejection slippage of the ink after solid printing for continuous 10 hours and a change of the ink droplet amount before and after the printing were measured.

E (Excellent ejection stability): No deterioration of an ejection slippage and no change of the ink droplet amount were substantially observed.

P (Poor ejection stability to some extent): Either deterioration of an ejection slippage or a change of the ink droplet amount was observed.

B (Bad or very poor ejection stability): Both deterioration of an ejection slippage and a change of the ink droplet amount were observed.

*5 The ink was put into a 50 ml graduated measuring cylinder and left at normal temperature for two weeks; then, the amount of dye that existed in the portion of upper 10% was determined by absorptiometry (diluted with acetone). The judgment was made by comparison of this value to the corresponding value at the initial stage.

E (Excellent): 0.98 or higher

F (Fair): Not less than 0.95 and less than 0.98

P (Poor): Less than 0.95

TABLE 2-continued

| Ink | Bleeding *1 | Level dyeing *2 | Color stability *3 | Ejection stability *4 | Storability Sediment *5 | Storability PP. *7 Change *6 |
|---|---|---|---|---|---|---|

*6 The ink that was kept at normal temperature for three months was stirred enough, and the viscosity and the surface tension were compared with those values of the initial conditions.
E (Excellent): Both viscosity and surface tension varied not more than 5%.
F (Fair): Either viscosity or surface tension varied not less than 5%.
P (Poor): Both viscosity and surface tension varied not less than 5%.
*7 PP.: Physical Properties

What is claimed is:

1. An ink for ink-jet printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained.

2. The ink for ink-jet printing according to claim 1, wherein said compound that disperses said disperse dye is selected from the group consisting of formalin condensates of naphthalenesulfonic acid and their derivatives, water-soluble polymer compounds having a carboxyl group or its salt in the side chain.

3. The ink for ink-jet printing according to claim 1, wherein an amount of bishydroxyethylsulfone is in a range of from 2 to 40% of the whole weight of the ink.

4. The ink for ink-jet printing according to claim 1, wherein the water-soluble organic solvent that is used in combination is selected from the group consisting of glycerol, ethylene glycol, diethylene glycol, triethylene glycol, tetraethylene glycol, thiodiglycol, propylene glycol, dipropylene glycol, tripropylene glycol and their derivatives.

5. The ink for ink-jet printing according to claim 1, wherein an ejecting system is a system in which said ink is ejected by applying thermal energy.

6. The ink for ink-jet printing according to claim 1; wherein said ink has a viscosity of from 2 to 10 mPa·s and a surface tension of from 30 to 50 dyn/cm.

7. A method for ink-jet printing comprising the steps of:

providing an ink for ink-jet printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained;

performing ink-jet printing on a cloth containing fiber which can be dyed with a disperse dye; and subjecting the cloth to a thermal treatment.

8. The method for ink-jet printing according to claim 7, wherein at least two kinds of inks are mixed on the cloth for forming a mixed color.

9. The method for ink-jet printing according to claim 7, wherein the cloth comprises polyester fiber.

10. The method for ink-jet printing according to claim 7, wherein the thermal treatment is made by a high temperature steaming (HT steaming) or by a thermosol process.

11. The method for ink-jet printing according to claim 7, wherein an ejecting system is a system in which said ink is ejected using thermal energy.

12. The method for ink-jet printing according to claim 7, wherein a pretreatment is performed to said cloth before the ink is applied.

13. A method for transfer printing comprising the steps of:

providing an ink for ink-jet printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained;

performing ink-jet printing on a carrier to form an image; and transferring the image to a material comprising a cloth containing fiber which can be dyes with a disperse dye by a thermal treatment.

14. The method for transfer printing according to claim 13, wherein at least two kinds of inks are applied to the carrier.

15. The method for transfer printing according to claim 13, wherein the cloth comprises polyester fiber.

16. The method for transfer printing according to claim 13, wherein an ejecting system is a system in which said ink is ejected using thermal energy.

17. The method for transfer printing according to claim 13, wherein the carrier is a paper sheet.

18. The method for transfer printing according to claim 17, wherein the paper has a thickness ranging from 0.02 to 0.4 mm.

19. A printed matter which is printed by a method for ink-jet printing comprising the steps of:

providing an ink for ink-let printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained;

performing ink-let printing on a cloth containing fiber which can be dyed with a disperse dye; and subjecting the cloth to a thermal treatment.

20. A printed matter which is printed by a method for transfer printing comprising the steps of:

providing an ink for ink-let printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye Particles having a Particle diameter of not more than 200 nm occupy 85% by weight in a particle diameter distribution, and dye particles having a particle diameter of not less than 1,000 nm are substantially not contained;

performing ink-let printing on a carrier to form an image; and transferring the image to a material comprising a cloth containing fiber which can be dyed with a disperse dye by a thermal treatment.

21. A printing unit comprising an ink container portion with an ink held therein and a head from which the ink is ejected in the form of ink droplets, wherein said ink comprises a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dve Particles having a particle diameter of not more than 200 nm occupy 85% by weight in a particle diameter distribution, and dye particles having a particle diameter of not less than 1,000 nm are substantially not contained.

22. The printing unit according to claim 21 wherein the head comprises a head in which thermal energy is applied to the ink to eject ink droplets.

23. An ink cartridge comprising an ink container portion with an ink held therein, wherein said ink comprises a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained.

24. An ink-jet printing apparatus comprising a printing unit equipped with an ink container portion with an ink held therein and a head from which the ink is ejected in the form of ink droplets, wherein said ink comprises a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dve particles having a particle diameter of not more than 200 nm occupy 85% by weight in a particle diameter distribution, and dye particles having a Particle diameter of not less than 1,000 nm are substantially not contained.

25. The ink-jet printing apparatus according to claim 24, wherein the head portion comprises a head which ejects ink droplets by applying thermal energy to the ink.

26. An ink-jet printing apparatus comprising a printing head for ejecting ink, an ink cartridge having an ink container portion with ink held therein, and an ink feeder for feeding the ink held in the ink cartridge from the ink cartridge to the printing head, wherein said ink comprises a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained.

27. The ink-jet printing apparatus according to claim 26, wherein the printing head applies thermal energy to the ink to eject ink droplets.

28. A processed article obtained by further processing a printed matter which is printed by a method for ink-let printing comprising the steps of:

providing an ink for ink-let printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained;

performing ink-let printing on a cloth containing fiber which can be dyed with a disperse dye; and subjecting the cloth to a thermal treatment.

29. A processed article obtained by further processing a printed matter which is printed by a method for transfer printing comprising the steps of:

providing an ink for ink-jet printing comprising a disperse dye in an amount of from 0.1 to 15% by weight, a compound that disperses said disperse dye, a water-soluble organic solvent, bishydroxyethylsulfone and water, wherein said disperse dye has an average particle diameter in a range of from 150 to 400 nm, and dye particles having a particle diameter of not more than 200 nm occupy 85% by weight in a particle diameter distribution, and dye particles having a particle diameter of not less than 1,000 nm are substantially not contained;

performing ink-jet printing on a carrier to form an image; and transferring the image to a material comprising a cloth containing fiber which can be dyed with a disperse dye by a thermal treatment.

30. The processed article according to claim 28 or 29, which is obtained by cutting said printed matter into desired sizes, and then subjecting each of the cut pieces to steps for obtaining a final processed article.

* * * * *

UNITED STATES PATENT AND TRADEMARK OFFICE

CERTIFICATE OF CORRECTION

PATENT NO. : 5,764,261
DATED : June 9, 1998
INVENTOR(S) : Shoji Koike et al.

It is certified that error appears in the above-identified patent and that said Letters Patent is hereby corrected as shown below:

Title page,
Item [56], References Cited, OTHER PUBLICATIONS,
"JP 62-121-776" should read -- JP 62-121,776 --.

Column 1,
Line 7, "conducting," should be deleted.
Line 13, "a" should be deleted.
Line 20, "difficult to" should read -- have difficulty in --.
Line 21, "cope" should read -- coping --.
Line 26, "for" should read -- from --.
Line 31, "after" should read -- after the --.
Line 49, "performance" should read -- required performance --.
Line 50, "required" should be deleted.
Line 54, "such problems are" should read -- it is --.
Line 58, "temperature or" should read -- temperatures or after being --.
Line 63, "result" should read -- results --.
Line 67, "is" should read -- are --.

Column 2,
Line 1, "is" should be deleted.
Line 7, "it has been" should be deleted.
Line 8, "generally conducted to make" should be deleted and "dye" should read -- dye generally has been made --.
Line 17, "case" should read -- the case --.
Line 29, "dye contained" should read -- the dye contained in the ink --.
Line 30, "presence" should read -- the presence --.
Line 35, "to obtain a" should read -- in obtaining --.
Line 41, "have not yet been" should read -- is not yet --.
Line 43, "satisfy" should read -- satisfies --.
Line 48, "processes," should read -- process, --.
Line 52, "requirement" should read -- the requirement --.
Line 55, "requirement" should read -- the requirement --.
Line 56, "a" (both occurrences) should be deleted.
Line 57, "systems" should read -- systems, --.
Line 59, "requirement" should read -- the requirement -- and "a" should be deleted.
Line 60, "a" should be deleted.

UNITED STATES PATENT AND TRADEMARK OFFICE

CERTIFICATE OF CORRECTION

PATENT NO. : 5,764,261
DATED : June 9, 1998
INVENTOR(S) : Shoji Koike et al.

It is certified that error appears in the above-identified patent and that said Letters Patent is hereby corrected as shown below:

Column 3,
Line 43, "dyes" should read -- dyed --.
Line 64, "above-" should read -- the above- --.

Column 4,
Line 2, "in" should read -- at --.
Line 5, "of" should be deleted.
Line 9, "size" should read -- in size --.
Line 12, "irregularity," should read -- irregularity and --.
Line 13, "portion;" should read -- portions; --.
Line 16, "with a" should read -- to -- and "its" should be deleted.
Line 17, "of" (second occurrence) should be deleted.
Line 18, "phenomena" should read -- phenomenon --.
Line 23, "the" should read -- a --.
Line 24, "the" should be deleted.
Line 32, "an" should read -- the --.
Line 43, "droplet" should read -- droplets -- and "in case of" should read -- when --.
Line 48, "a" (both occurrences) should be deleted.
Line 49, "remarkable in case of" should read -- noticeable in --.
Line 50, "case of" should be deleted.
Line 58, "details" should read -- detail --.

Column 5,
Line 3, "an" should be deleted.
Line 4, "size" should be deleted.
Line 5, "remarkable" should read -- noticeable -- and "of a" should read -- in --.
Line 7, "case of" should be deleted.
Line 11, "a" (first occurrence) should read -- the --.
Line 15, "a content" should read -- the amount --.
Line 19, "of" should be deleted.
Line 22, "of" should be deleted.
Line 23, "a" should read -- the --. (1st occurrence)
Line 29, "An average" should read -- Average -- and "a" should be deleted.
Line 31, "by" should read -- using a --.
Line 38, delete in its entirety.
Line 39, "disperse" should read -- The disperse -- and "invention:" should read -- invention is preferably, but is not limited to, the following: --.
Line 60, "of" should read -- in --.

UNITED STATES PATENT AND TRADEMARK OFFICE

CERTIFICATE OF CORRECTION

PATENT NO. : 5,764,261
DATED : June 9, 1998
INVENTOR(S) : Shoji Koike et al.

It is certified that error appears in the above-identified patent and that said Letters Patent is hereby corrected as shown below:

Column 6,
Line 48, “such solvent” should read -- of such solvents --.

Column 7,
Line 13, "pH" should read -- and pH --.
Line 30, "in common with a" should read -- suitable for --.
Line 31, "a" should be deleted.
Line 34, "the" should be deleted.
Line 43, "in mix" should read -- mixed --.
Line 51, "is" should read -- rides --. (2nd occurrnce)
Line 59, "a" should be deleted.

Column 8,
Line 3, "raides" should read -- rides --.
Line 7, "the" (second occurrence) should be deleted.
Line 20, "sufactant," should read -- surfactant, --.
Line 22, "surfactans" should read -- surfactants --.
Line 23, "sulfates," should read -- sulfates and --.
Line 63, "vanish" should read -- varnish --.
Line 65, "vanish" should read -- varnish --.

Column 9,
Line 3, "cellolose" should read -- cellulose --.
Line 6, "most" should read -- the most --.
Line 15, "ink" should read -- the ink -- and "to" should read -- into the --.
Line 22, "most" should read -- the most --.
Line 24, "a" should read -- the --.
Line 25, "a" should read -- the --.
Line 26, "a" should read -- the --.
Line 32, "explained in more details." should read -- explained below in more detail. --.
Line 33, "an" should read -- a --.
Line 37, "to" should read -- through --.
Line 38, "to head regardless of" should read -- to the head shown in --.
Line 59, "ink" should read -- the ink -- and "FIG. 2" should read -- FIG. 2 is --.

UNITED STATES PATENT AND TRADEMARK OFFICE

CERTIFICATE OF CORRECTION

PATENT NO. : 5,764,261
DATED : June 9, 1998
INVENTOR(S) : Shoji Koike et al.

It is certified that error appears in the above-identified patent and that said Letters Patent is hereby corrected as shown below:

Column 10,
Line 13, "off" should be deleted.
Line 25, "the" should read -- one --.
Line 27, "from" should read -- into --.

Column 11,
Line 29, "at" should read -- at a --.
Line 31, "at" should read -- at a --.
Line 32, "case" should read -- the case --.
Line 33, "at" should read -- at a --.
Line 34, "at" should read -- at a --.
Line 43, "Steaming" should read -- A steaming --.
Line 67, "spinned" should read -- spun --.

Column 12,
Line 24, "a" should read -- the respective --.
Line 25, "respectively" should be deleted.
Line 26, "made" should read -- performed --.
Line 30, "additional" should read -- the additional --.
Line 33, "solutions" should read -- solution --.
Line 37, "solutions" should read -- solution --.
Line 42, "solutions" should read -- solution --.
Line 45, "solutions" should read -- solution --.
Line 49, "solutions" should read -- solution --.
Line 53, "solutions" should read -- solution --.
Line 57, "solutions" should read -- solution --.
Line 62, "solutions" should read -- solution --.
Line 66, "decyne" should read -- decene --.

Column 13,
Line 16, "each" should be deleted and "samples" should read -- samples from each --.
Line 18, "fixation was made" should read -- the ink was fixed --.
Line 20, "water" should read -- with water --.
Line 25, "for continuous 10 hours was" should be deleted.
Line 26, "made" should read -- was performed continuously for 10 hours --.
Line 40, "solutions" should read -- solution --.
Line 44, "decyne" should read -- decene --.
Line 63, "solutions" should read -- solution --.

UNITED STATES PATENT AND TRADEMARK OFFICE

CERTIFICATE OF CORRECTION

PATENT NO. : 5,764,261
DATED : June 9, 1998
INVENTOR(S) : Shoji Koike et al.

It is certified that error appears in the above-identified patent and that said Letters Patent is hereby corrected as shown below:

Column 14,
Line 5, "decyne" should read -- decene --.
Line 21, "solutions" should read -- solution --.
Line 27, "a problematic level." should read -- problematic. --.
Line 31, "solutions" should read -- solution --.
Line 32, "solutions" should read -- solution -- and "Ink (d)" should read -- Ink (e) --.
Line 38, "a problematic level." should read -- problematic. --.
Line 43, "solutions" should read -- solution --.
Line 44, "solutions (V);" should read -- solution (VI); -- and "Ink (e)" should read -- Ink (f) --.
Line 49, "a problematic level." should read -- problematic. --.
Line 54, "solutions" should read -- solution --.
Line 55, "solutions" should read -- solution -- and "made" should read -- performed --.
Line 60, "at a level of problem." should read -- problematic. --.
Line 67, "printing densities" should read -- the printing density -- and "is" should read -- was --.

Column 15,
Line 3, "water" should read -- with water --.
Line 8, "resulted in same way." should read -- had the same result. --.
Line 17, "period." should read -- periods. --.
Line 25, "printing densities" should read -- printing density -- and "is" should read -- was --.
Line 27, "wholes" should read -- resulting compositions --.
Line 30, "water washing," should read -- water washing, and --.
Line 33, "steamings" should read -- steaming -- and "resulted in" should read -- led to the same result. --.
Line 34, "same way." should be deleted.
Line,43, "period." should read -- periods. --.
Line 46, "above;" should read -- above, --.
Line 52, "ink-jet" should read -- ink-jet printing --.
Lin'e 59, "is" should read -- are --.
Line 65, "to" (second occurrence) should be deleted.

UNITED STATES PATENT AND TRADEMARK OFFICE

CERTIFICATE OF CORRECTION

PATENT NO. : 5,764,261
DATED : June 9, 1998
INVENTOR(S) : Shoji Koike et al.

It is certified that error appears in the above-identified patent and that said Letters Patent is hereby corrected as shown below:

Column 16,
Line 54, "for continuous" should read -- continuously for --.

Column 17,
Line 10, "enough," should be deleted.

Column 18,
Line 24, "dyes" should read -- dyed --.
Line 41, "ink-let" should read -- ink-jet --.
Line 57, "ink-let" should read -- ink-jet --.
Line 63, "Particles" should read -- particles -- and "Particle" should read -- particle --.

Column 19,
Line 13, "dve Particles" should read -- dye particles --.
Line 40, "dve" should read -- dye --.
Line 42, "Particle" should read -- particle --.

Column 20,
Line 12, "ink-let" should read -- ink-jet --.
Line 14, "ink-let" should read -- ink-jet --.
Line 25, "ink-let" should read -- ink-jet --.

Signed and Sealed this

Twenty-seventh Day of August, 2002

*Attest:*

*Attesting Officer*

JAMES E. ROGAN
*Director of the United States Patent and Trademark Office*